US005402854A

United States Patent [19]

Kimberlin et al.

[11] Patent Number: 5,402,854

[45] Date of Patent: Apr. 4, 1995

[54] FLUID DISTRIBUTOR FOR A DEBRIS FLUSHING SYSTEM IN A PERCUSSIVE, FLUID-ACTIVATED APPARATUS

[75] Inventors: Robert R. Kimberlin, Troutville, Va.; Duane K. Emerson, Macungie, Pa.; Richard S. Holland, Roanoke, Va.

[73] Assignee: Ingersoll-Rand Company, Woodcliff Lake, N.J.

[21] Appl. No.: 197,663

[22] Filed: Feb. 17, 1994

Related U.S. Application Data

[63] Continuation of Ser. No. 957,340, Oct. 6, 1992, abandoned.

[51] Int. Cl.[6] ..... E21B 4/14

[52] U.S. Cl. ..... 173/17; 173/73; 173/78; 173/80

[58] Field of Search ..... 173/17, 63, 64, 67, 173/70, 73, 78, 80, 197; 175/92

[56] References Cited

U.S. PATENT DOCUMENTS

| | | | |
|---|---|---|---|
| 2,810,550 | 4/1952 | Cohen et al. . | |
| 3,077,937 | 2/1963 | Tirapolsky et al. . | |
| 3,133,603 | 1/1960 | Lagacherier et al. . | |
| 3,527,239 | 9/1970 | Boom | 173/64 |
| 3,768,576 | 10/1973 | Martini | 173/73 |
| 3,795,283 | 3/1974 | Oughton . | |
| 3,964,551 | 6/1976 | Bassinger | 173/73 |
| 3,991,834 | 11/1976 | Curington . | |
| 4,133,393 | 1/1979 | Richards | 173/17 |
| 4,280,570 | 7/1981 | Walter | 173/80 |
| 4,446,929 | 5/1984 | Pillow | 173/80 |
| 4,496,007 | 1/1985 | Zinck . | |
| 5,090,497 | 2/1992 | Beimgraben et al. . | |
| 5,115,875 | 5/1992 | Ennis | 173/80 |

*Primary Examiner*—Scott A. Smith
*Attorney, Agent, or Firm*—John J. Selko

[57] ABSTRACT

A fluid distributor for a debris flushing system in a fluid-activated jackhammer includes a bore through a reciprocal piston, for fluid flow into an exhaust chamber, a fluid distributor removably mounted in the piston bore, the fluid distributor operating by forming passageways through the bore and blocking flow in other portions of the bore. The distributor can have a tapered body that can be severed along its length by the operator to provide a plurality of preselected, fixed flow rates.

9 Claims, 2 Drawing Sheets

FLUID DISTRIBUTOR FOR A DEBRIS FLUSHING SYSTEM IN A PERCUSSIVE, FLUID-ACTIVATED APPARATUS

This application is a continuation of application Ser. No. 07/957,340, filed Oct. 6, 1992, now abandoned.

BACKGROUND OF THE INVENTION

This invention relates generally to a debris flushing systems in a percussive, fluid-activated apparatus, and more particularly to a fluid distributor for controlling the volume of fluid flow in a debris flushing system of a fluid-activated jackhammer.

The function of a fluid distributor, called a blower tube, in a jackhammer or drifter application is to allow percussive fluid (air) to pass from some high pressure air source through a hole into the tube, and thereafter to flow through to the drill steel, to remove broken rock from the front of the drill steel. Traditional blower tube geometry consists of a hollow tube which is rigidly mounted to the device on one end. The free end of the tube is piloted through a bore in the surrounding piston. Traditional blower tubes usually permit only one preselected volume of fluid flow therethrough. Such a tube cannot be modified in the field to permit a selection of several volumes of fluid flow.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a debris flushing system in a fluid-activated apparatus having a bore through a reciprocal piston in fluid communication with an accumulator chamber and an exhaust chamber, a fluid distributor in the piston bore, for controlling the amount of fluid flow at a preselected, fixed flow rate, the distributor being removably mounted in the piston bore.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
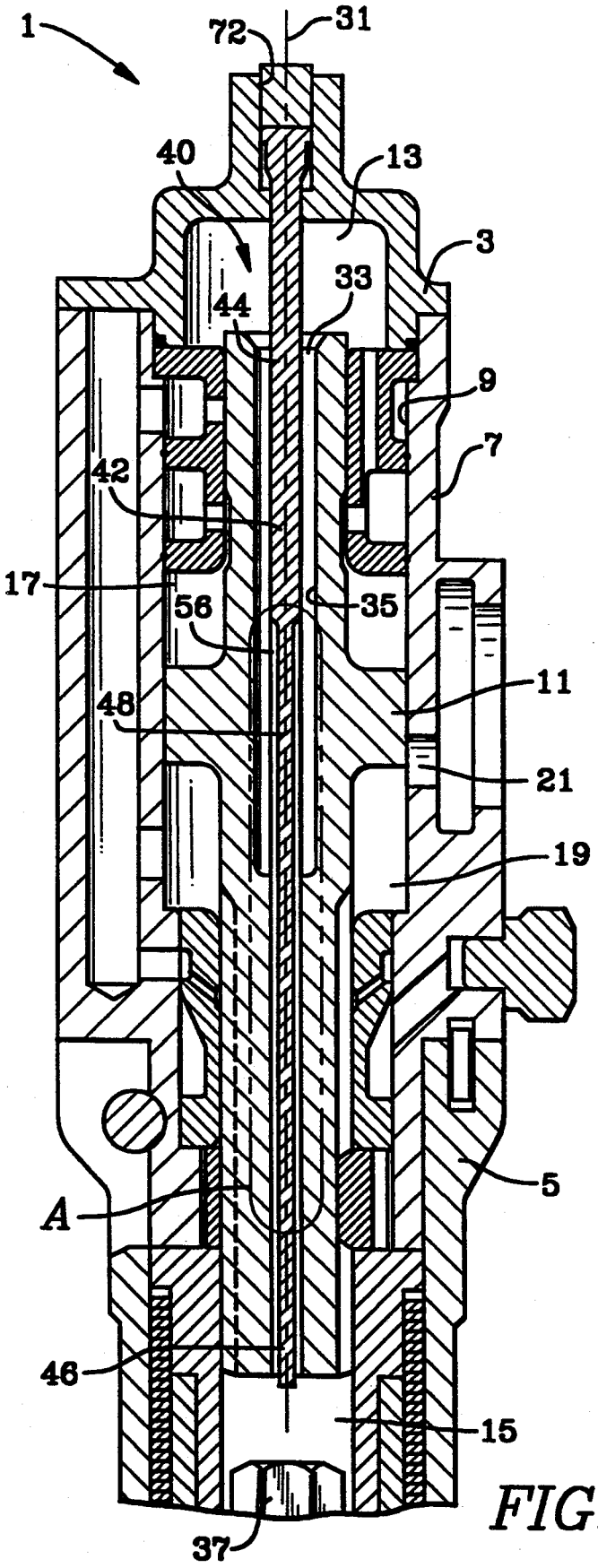
FIG. 1 is schematic cross section, with parts removed, of a jackhammer having the flushing system of the invention.
Figure 2:
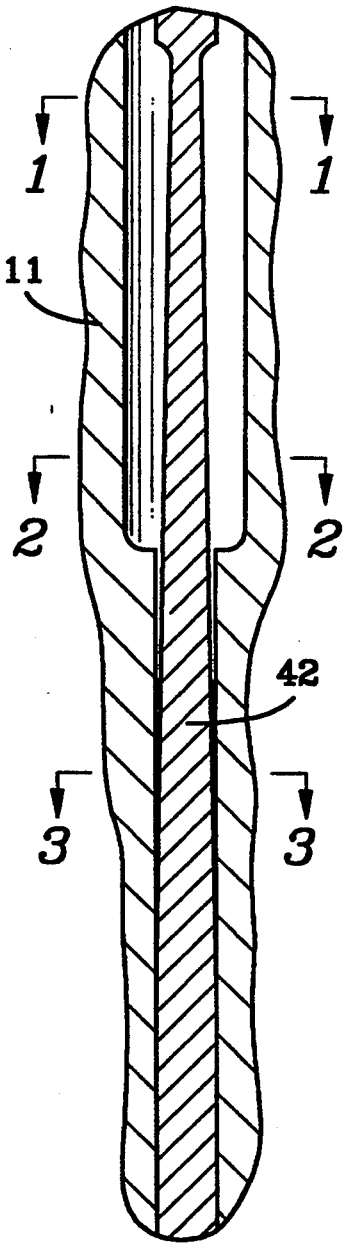
FIG. 2 is an enlarged view of the area A encircled in FIG. 1, but with a tapered fluid distributor.

Referring to the drawings, FIG. 1 shows a fluid-activated drilling apparatus 1, having a backhead 3 at a top end, a fronthead 5 at a bottom end, a housing 7 therebetween forming a central bore 9 having therein a reciprocal piston 11. Central bore 9 also has therein an accumulator chamber 13 at backhead 3, in fluid communication with an inlet port (not shown) for receiving high pressure percussive fluid to activate piston 11. Bore 9 also has therein a front piston chamber 15, for receiving and exhausting a flushing fluid. Piston 11 reciprocates between a drive chamber 17 and a return chamber 19 on either side of an exhaust port 21, as is well know.

Extending through piston 11 on a longitudinal centerline 31 is a piston bore 33, which bore 33 is defined by a piston bore sidewall 35. Bore 33, when viewed in a horizontal cross section, as shown in FIGS. 2–5, is circular in shape but it could be other shapes also. As used herein, the term "horizontal cross section" refers to a view in a plane that is transverse to, and perpendicular to, longitudinal centerline 31. Bore 33 can have more than one internal diameter, as shown in FIG. 1.

Piston bore 33 is in fluid communication with front piston chamber 15, whereby a portion of percussive fluid in accumulator chamber 13 flows into front piston chamber 15 to exhaust debris from around drill steel 37.

Fluid flow distributor means 40 extends into bore 33 for controlling the volume of fluid flowing in piston bore 33, in a preselected, but fixed, amount. Distributor means 40 is removably mounted in piston bore 33, as described hereinafter.

Distributor means 40 includes an elongated distributor 42 extending in piston bore 33, which distributor has a first end 44, a second end 46 and an elongated body 48 therebetween.

As seen in FIGS. 2–5, elongated body 48 has a first body surface portion 50 in bearing contact with sidewall 35 of piston bore 33. Bearing contact is needed to support body 48 and to minimize vibration of body 48. Body 48 also has a second body portion 52 spaced from sidewall 35 of piston bore 33. Body portions 50 and 52 extend lengthwise along body 48, to provide a passageway 56 between body 50 and sidewall 35 for fluid flow in piston bore 33. Otherwise distributor means 40, being solid and not a hollow tube, would block flow of fluid in piston bore 35.

We prefer to provide a pair of oppositely positioned, spaced-apart body portions 50 and 52, when viewed in the horizontal cross section, so that there are a plurality of passageways 56 for fluid flow.

Figures 3, 4, 5, 6:
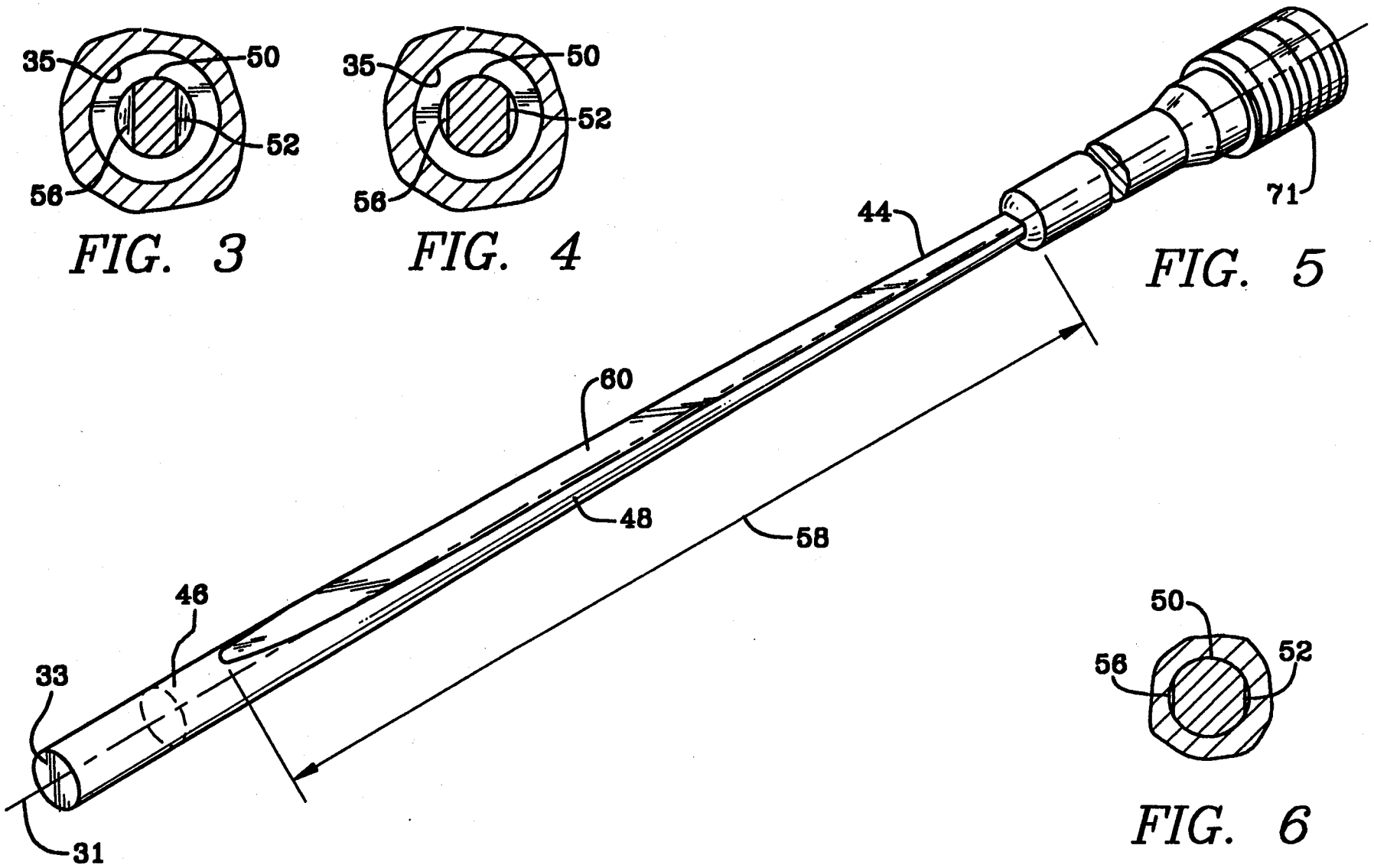
FIG. 3 is a view along 1—1 of FIG. 2.
FIG. 4 is a view along 2—2 of FIG. 2.
FIG. 5 is a view along 3—3 of FIG. 2.
FIG. 6 is a perspective view of the fluid distributor of the invention.

Body 48 is tapered in the mid section 58, as shown in FIG. 6, from a larger size adjacent second end 46 to a smaller size adjacent first end 44, whereby body 48 blocks a greater portion of bore 33 (and fluid flow therein) adjacent second end 46 than adjacent first end 44. Thus, it can be understood that the amount of fluid flow is determined by the minimum clearance of passageway 56 between body 48 and sidewall 35. Also, this minimum passageway 56 can be varied from a first fixed amount to a larger, fixed amount by an operator cutting the tapered body 48 at a position along its length that provides a larger clearance between body 48 and sidewall 35.

As shown in FIG. 6, when bore 33 is circular in horizontal cross section, body 48 is cylindrical with at least one flat, planar surface 60 extending therealong We prefer a pair of oppositely spaced-apart surfaces 60. Each surface 60 tapers inwardly toward longitudinal centerline 31 starting at an outermost position adjacent second end 46, and ending at an innermost position toward first end 44.

First end 44 includes a threaded portion 70 which threads into an aperture 72 (FIG. 1) in backhead 3, for removably mounting of distributor 40. First end 44 is elongated enough to extend across accumulator chamber 13 to pilot into bore 33, as described hereinabove.

In operation, the operator preselects the amount of fluid flow by cutting the body 48 at a position along its length that provides the desired clearance between body 48 and sidewall 35. This clearance fixes the amount of fluid flow. To increase the fluid flow, the operator removes the distributor 40 and cuts the body 48 at a different position. Of course, the fluid flow can only be adjusted upwardly in this fashion. However, by providing the body 48 with an initial dimension at second end 46 to completely block bore 33, the operator can select any flow desired, and the need for a large number of different blow tubes in the field is avoided.

We prefer to make distributor 40 from a suitable plastic material. By having body 48 as a solid body instead of a hollow tube, the part is easier and less expensive to make.

While we have disclosed the body as tapered, it would be equivalent to substitute grooves of tapering depth in a uniformly sized body 48, to provide a variable clearance between body 48 and sidewall 35.

Having described the invention, what is claimed is:

1. A debris flushing system in a percussive, fluid-activated drilling apparatus, said apparatus having a backhead at a top end, a fronthead at a bottom end, a housing therebetween forming a central bore having therein a reciprocal piston, said central bore having therein an accumulator chamber at said backhead, in fluid communication with an inlet port for receiving percussive fluid to activate said piston, and a front piston chamber for receiving and exhausting a flushing fluid, said flushing system comprising:

a bore having a longitudinal centerline through said piston in fluid communication between said accumulator chamber and said front piston chamber, whereby a portion of percussive fluid in said accumulator chamber flows to said front piston chamber;

fluid distributor means in said piston bore, for controlling the volume of fluid flowing in said piston bore in a preselected, fixed amount, said distributor means being a solid body blocking fluid flow within said distributor means, while permitting fluid flow in at least one portion of said piston bore spaced from said longitudinal centerline; and means for removably mounting said fluid distributor means in said piston bore.

2. The flushing system of claim 1 wherein said fluid distributor means comprises:

an elongated fluid distributor extending in said piston bore, to block fluid flow in said piston bore;

said fluid distributor having a first end, a second end and an elongated body therebetween;

said body having a first body surface portion thereon in bearing contact with a sidewall of said piston bore, lengthwise therealong; and said body having a second body surface portion thereon spaced from said sidewall of said piston bore, lengthwise therealong, to provide at least one passageway between said body and said sidewall, for fluid flow in said piston bore.

3. The fluid distributor of claim 2 further comprising:

said distributor body, when viewed in a horizontal cross section, having a plurality of spaced-apart bearing surfaces in contact with a sidewall of said piston bore, lengthwise therealong; and a plurality of spaced-apart body surface portions thereon spaced from said sidewall of said piston bore, lengthwise therealong, to provide a plurality of passageways for fluid flow in said piston bore.

4. The fluid distributor of claim 2 further comprising:

said body being tapered from a smaller size adjacent said first end to a larger size adjacent said second end, whereby said body blocks a greater portion of fluid flow adjacent said second end than adjacent said first end.

5. A fluid distributor for a debris flushing system in a percussive, fluid-activated apparatus, said apparatus having a backhead at a top end, a fronthead at a bottom end, a housing therebetween forming a central housing bore, said central housing bore having therein a reciprocal piston, said piston having extending therethrough a central piston bore, for fluid communication between said backhead and a front piston fluid exhaust chamber, said central piston bore being defined by a piston bore sidewall, said fluid distributor comprising:

a body having a first end, a second end and a tapered section therebetween;

said tapered section having a first bearing surface portion thereon adapted to contact a sidewall of said piston bore, lengthwise therealong, to support said body in said piston bore;

said tapered section having a second surface portion thereon adapted to be spaced from said sidewall of said piston bore, lengthwise therealong, to provide at least one passageway between said body and said sidewall, for fluid flow in said piston bore;

said body being solid to block fluid flow in said body while permitting fluid flow in said passageway between said body and said sidewall; and means on said first end for removably mounting said distributor in said backhead for extension into said piston bore.

6. The distributor of claim 5 wherein said body is tapered from a smaller size adjacent said first end to a larger size adjacent said second end, whereby said body blocks a greater portion of fluid flow adjacent said second end than adjacent said first end.

7. A fluid distributor for a debris flushing system in a percussive, fluid-activated apparatus, said apparatus having a backhead at a top end, a fronthead at a bottom end, a housing therebetween forming a central housing bore, said central housing bore having therein a reciprocal piston, said piston having extending therethrough a central piston bore, for fluid communication between said backhead and a front piston fluid exhaust chamber, said central piston bore being defined by a piston bore sidewall, said fluid distributor comprising:

a body having a first end, a second end and a tapered section therebetween;

said tapered section having a pair of spaced-apart first bearing surface portions thereon adapted to contact a sidewall of said piston bore, lengthwise therealong, to support said body in said piston bore;

said tapered section having a pair of spaced-apart second surface portions thereon adapted to be spaced from said sidewall of said piston bore, lengthwise therealong, to provide a plurality of passageways between said body and said sidewall, for fluid flow in said piston bore;

means on said first end for removably mounting said distributor in said backhead for extension into said piston bore;

said body being tapered from a smaller size adjacent said first end to a larger size adjacent said second end, whereby said body blocks a greater portion of fluid flow adjacent said second end than adjacent said first end; and said piston bore, when viewed in horizontal cross section, is circular and said body is cylindrical, with each of said second surface portions on said tapered section being a flat, planar surface.

8. The distributor of claim 7 wherein each of said flat, planar surfaces of said tapered section tapers inwardly toward a longitudinal centerline of said body, starting at an outermost position adjacent said second end and ending at an innermost position adjacent said first end.

9. The distributor of claim 8 wherein said body is a single piece, with said first end being adapted for threadable connection to a backhead of said apparatus.

* * * * *